US005873423A

United States Patent [19]

Briese

[11] Patent Number: 5,873,423

[45] Date of Patent: Feb. 23, 1999

[54] FRUSTUM CUTTING BIT ARRANGEMENT

[75] Inventor: Leonard Arden Briese, Harbor City, Calif.

[73] Assignee: Briese Industrial Technologies, Inc., Harbor City, Calif.

[21] Appl. No.: 903,554

[22] Filed: Jul. 31, 1997

[51] Int. Cl.[6] ..... E21B 10/36

[52] U.S. Cl. ..... 175/427; 175/430; 299/100; 299/113

[58] Field of Search ..... 175/426, 427, 175/430; 299/100, 112, 113

[56] References Cited

U.S. PATENT DOCUMENTS

| | | | |
|---|---|---|---|
| 1,542,007 | 6/1925 | Schroeder . | |
| 2,862,286 | 12/1958 | Williams . | |
| 3,049,033 | 8/1962 | Benjamin et al. . | |
| 3,106,972 | 10/1963 | Thornsberry . | |
| 3,163,246 | 12/1964 | Vagins et al. . | |
| 3,262,184 | 7/1966 | Sweeny . | |
| 3,434,553 | 3/1969 | Weller . | |
| 3,759,625 | 9/1973 | Iversen . | |
| 3,765,496 | 10/1973 | Flores et al. . | |
| 4,086,972 | 5/1978 | Hansen . | |
| 4,109,737 | 8/1978 | Bovenkerk | 175/430 |
| 4,190,125 | 2/1980 | Emmerich et al. . | |
| 4,416,489 | 11/1983 | Haggenmacher | 299/100 |
| 4,477,211 | 10/1984 | Briese . | |
| 4,511,006 | 4/1985 | Grainger . | |
| 4,621,955 | 11/1986 | Briese . | |
| 4,627,503 | 12/1986 | Horton . | |
| 4,645,386 | 2/1987 | Smith . | |
| 4,682,916 | 7/1987 | Briese . | |
| 4,733,735 | 3/1988 | Barr et al. . | |
| 4,733,992 | 3/1988 | Aebi . | |
| 4,817,742 | 4/1989 | Whysong . | |
| 4,819,748 | 4/1989 | Truscott . | |
| 4,893,967 | 1/1990 | Briese . | |
| 4,984,944 | 1/1991 | Pennington, Jr. et al. . | |
| 4,993,888 | 2/1991 | Briese . | |
| 5,038,859 | 8/1991 | Lynde et al. . | |
| 5,099,929 | 3/1992 | Keith et al. . | |
| 5,103,922 | 4/1992 | Jones . | |
| 5,160,232 | 11/1992 | Maier . | |
| 5,226,489 | 7/1993 | Woods et al. . | |
| 5,287,937 | 2/1994 | Sollami et al. . | |
| 5,311,959 | 5/1994 | Adams . | |
| 5,363,932 | 11/1994 | Azar . | |
| 5,433,281 | 7/1995 | Black . | |
| 5,456,329 | 10/1995 | Dennis et al. . | |
| 5,456,522 | 10/1995 | Beach | 299/113 |
| 5,458,210 | 10/1995 | Sollami . | |
| 5,458,211 | 10/1995 | Dennis et al. . | |
| 5,645,323 | 7/1997 | Beach | 299/113 X |

FOREIGN PATENT DOCUMENTS

| | | |
|---|---|---|
| 776939 | 11/1934 | France . |
| 713504 | 10/1941 | Germany . |
| 523761 | 10/1976 | U.S.S.R. . |
| 607660 | 5/1978 | U.S.S.R. . |
| 607770 | 9/1948 | United Kingdom . |
| 2057939 | 4/1981 | United Kingdom . |

OTHER PUBLICATIONS

Leonard A. Briese—Jul. 1996 "Harts Petroleum Engineer International", Disc Cutter Bits Offer Potential Penetration Rates, pp. 11.

*Primary Examiner*—Roger J. Schoeppel
*Attorney, Agent, or Firm*—Don Finkelstein

[57] ABSTRACT

A frustum cutting bit arrangement, including a shank portion for mounting in, and to be retained by, a rotary cutting tool body, the shank portion having an axis, an inner axial end, and an outer axial end. A head portion has an axis coincident with the shank portion axis, a front axial end, and a rear axial end, the rear end coupled to the shank portion outer end, and the front end having a conical cavity therein diminishing in diameter from the front end toward the rear end. A frustum cutting insert has an axis coincident with the head portion axis, a forward axial end, a back axial end, and an outer conical surface diminishing in diameter from the forward end toward the back end, the conical cavity and the outer conical surface having substantially the same taper, the frustum cutting insert fitting into the cavity in a taper lock. In variations of the basic invention, the head portion may be rotatable with respect to the shank portion, the frustum cutting insert may comprise a rotating cutter therein, and combinations of such features may be provided for different applications.

26 Claims, 5 Drawing Sheets

FRUSTUM CUTTING BIT ARRANGEMENT

BACKGROUND OF THE INVENTION

1. Field of the Invention

This invention relates to the field of rotary cutting tools, and in particular to an improved cutting bit arrangement for mounting to a rotary cutting tool which typically carries a number of such cutting bit arrangements on its body.

2. Brief Description of the Prior Art

Rotary cutting tools having a rotating body portion carrying a number of cutting bits are known in the art. Such rotating cutting tools may have as many as 100 or more cutting bits fixed to the body of the rotating cutting tool for cutting, drilling, surfacing, or otherwise forming holes, channels, or tunnels in, hard material or substance formations. Rotary cutting tools of this type are used extensively in the mining industry, in particular.

Replaceable cutting bits for mounting in, and to be retained by, a rotary cutting tool body are also well known. Such cutting bits have a shank portion insertable and locked into a cavity in the rotary tool body and a head portion projecting away from the rotary tool body, a number of separate cutting bits being carried by the rotary tool body. However, each projecting head portion of such a prior art cutting bit typically has a conical nose tip of tungsten carbide brazed on the end of the cutting bit head. The tungsten carbide tip contacts the material being cut in a gouging, scraping, or compression fracturing action, chipping away at the rock or earth strata by the thrust forces applied to the rotary tool body.

In this connection, rock, or stone, may be fractured by means of compressive or tensile forces. It requires much greater compression forces than tensile forces to fracture rock. Prior art rotating cutting tools generally drive their mounted cutting bits into the rock using compressive forces to fracture the rock. With such prior art cutting bits, the compressive fracture forces are directed only outwardly and in the cutting (drilling) direction from the cutter point. As a result, compared to tensile fracturing, greater horsepower is required, wear on equipment and tools is greatly increased, and excessive heat may be generated leading to possible explosion.

There are several other problems associated with such prior art cutting bits. A major problem is wear on the nose tip due to heat and pressure experienced in the cutting process. Such wearing down of the nose tip is not unexpected for a variety of reasons. First, in manufacturing the cutting bit, the tungsten carbide nose piece is the least dense at the extreme end of the conical tip where it is desired to be the most dense. This is due to the axial thickness of the nose piece tip being greatest between the base of the tip and its point. This is a known characteristic of formed tungsten carbide workpieces having regions of varying thicknesses. It would be desirable to have the cutting tip of a cutting bit formed of a hardened material, such as tungsten carbide, having high and constant density throughout.

Secondly, the heat generated during the brazing of a tip to a prior art cutter bit head degrades the hardness of the tip. It would be desirable to attach a cutting tip to a cutter bit without using high temperature techniques.

Thirdly, the same contacting portion of a prior art cutting bit hardened tip is exposed to the severe cutting engagement of the rock or substance being cut, and therefore builds up the temperature at the cutting tip, all contributing to a high wear rate. It would be desirable to provide a cutting bit tip which does not continuously present the same cutting portion of the cutter tip to the substance being cut, thereby allowing cooling of the portion of the cutter tip between cutting engagement strokes.

Additionally, it would be desirable to have the cutter tip effect tensile fracturing and a cutting action on the substance being cut, rather than employing compression fracturing or creating a gouging or scraping action as is made by the prior art conical nose cutting bits.

Prior art cutting bits have no provision to direct chips and debris away from the region being cut, so that debris around the cutting bits builds up and clogs the rotary cutting tool, at which time the rotary cutting tool must be withdrawn and cleaned, leading to inefficient drilling operation and costly down time and associated labor costs.

Another problem associated with prior art cutting bits is the cost of down time and labor involved with removal and replacement of worn or damaged cutting bits. It would be desirable to have a cutting bit with replaceable cutter tips, not practical with brazed-on carbide cone tips of the prior art.

SUMMARY OF THE INVENTION

The above-noted problems and shortcomings associated with prior art cutting bits are overcome with use of cutting bits made in accordance with the present invention.

The present invention provides a frustum cutting bit arrangement comprising a shank portion, a head portion, and a frustum cutting insert. The shank portion mounts in, and is retained by, a rotary cutting tool body, the shank portion having an axis, an inner axial end, and an outer axial end. The head portion has an axis coincident with the shank portion axis, a front axial end, and a rear axial end, the rear end coupled to the shank portion outer end, and the front end having a conical cavity therein diminishing in diameter from the front end toward the rear end. The frustum cutting insert has an axis coincident with the head portion axis, a forward axial end, a back axial end, and an outer conical surface diminishing in diameter from the forward end toward the back end, the conical cavity and the outer conical surface having substantially the same taper, the frustum cutting insert fitting into the cavity in a taper lock.

In one aspect of the invention, a head and shank portion mount to a rotary cutting tool body, and a cutting insert is fixed to the forward end of the head portion in a taper lock action. An access hole is provided in the head portion for the insertion of a cutting insert removal tool for wedging the cutting insert out of taper lock with the head portion of the cutting bit arrangement by tapping on the removable tool. The cutting insert may have a conical tip or it may be frusto conical in shape at its forward end to provide a cutting action on the substance being cut or fractured as opposed to a gouging, scraping, or compressive fracturing action.

The present invention provides mainly tensile fracturing forces in combination with compressive forces. The combined tensile and compressive forces are directed inwardly as well as outwardly and in the cutting (drilling) direction from the cutting edge, greatly increasing cutting efficiency, reducing required driver horsepower, reducing wear on equipment and tools, and reducing heat generation. Notches or lugs on the cutting edge may be employed to increase the multidirectional fracturing forces.

In another aspect of the invention, there is provided a frustum cutting bit arrangement having a stator mounted to the rotary tool body and a rotor, or rotating head, portion having a frustum cutting insert fixed to the forward portion thereof in a taper lock, or having the frustum cutting insert rotatable within the rotatable head, both the head and the cutting insert being rotatable independently.

A number of different configurations for the stator, rotor, and cutting inserts are proposed, each with their advantages for particular applications.

BRIEF DESCRIPTION OF THE DRAWING

The above and other aspects of the present invention and variations thereof may be more fully understood from the following detailed description, taken together with the accompanying drawings, wherein similar reference characters refer to similar elements throughout, and in which.

DETAILED DESCRIPTION OF THE PREFERRED EMBODIMENTS

Figure 1:
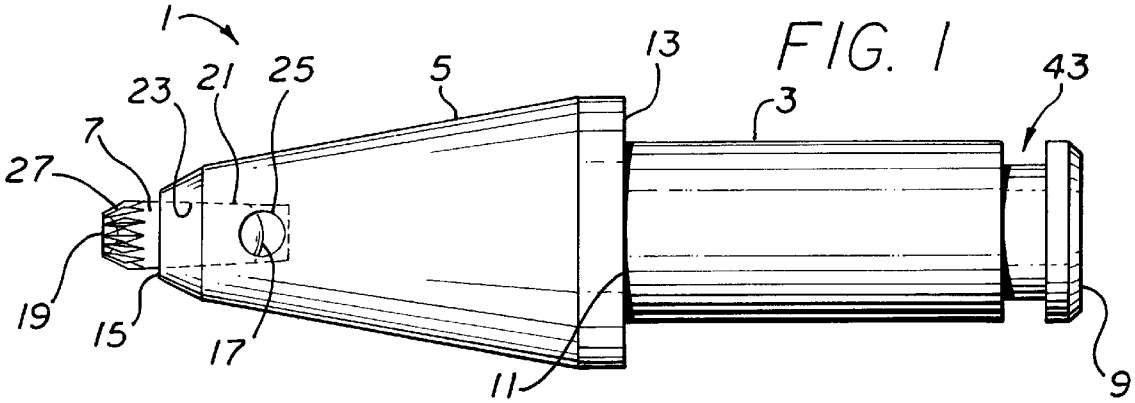
FIG. 1 is a side view of a frustum cutting bit arrangement in accordance with the present invention in which a shank portion is connected to a head portion, the latter having an opening to receive and lock with a cutting insert in accordance with one aspect of the present invention.
Figure 2:
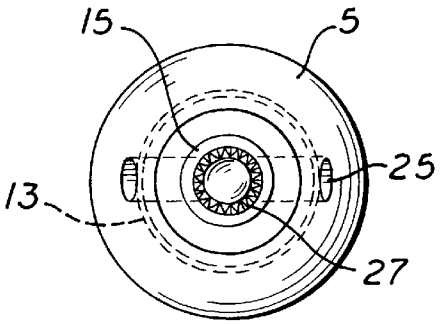
FIG. 2 is a left end view of the arrangement shown in FIG. 1.

FIG. 1 shows an example of the present invention in which a frustum cutting bit arrangement has no rotatable parts, although the entire cutting bit arrangement 1 itself may rotate within a cavity of a rotary cutting tool.

As shown in FIG. 1, a frustum cutting bit arrangement 1 has a shank portion 3 and a head, or body, portion 5 of conical shape diminishing toward the forward end thereof. The shank portion 3 is retained in a rotary cutting tool body (not shown) by any known means, for example by a locking ring (not shown) captured in annular groove 43.

A frustum cutting insert 7 is taper locked into the front end of head 5 in a manner commonly known in the mechanical art. The shank portion 3 has an inner end 9 and an outer end 11, the latter being attached to, or formed with, a rear end 13 of head 5. The head 5 has a front end 15 within which a frustum cutting insert 7 is taper locked. The frustum cutting insert has a back end 17, a forward end 19, and a tapered conical outer surface 21 taper locked to the inner tapered conical surface 23 of head 5.

Figure 1A:
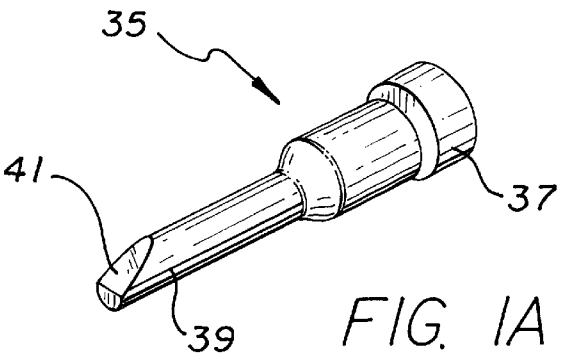
FIG. 1A is a perspective view of a cutting insert removal tool.

An access opening 25 for a removal tool 35 (FIG. 1A) is provided in the side of head 5, whereby a tapered wedge tip 41 of the tool, at the end of the tool shaft 39, is effective to push the frustum cutting insert 7 out of taper lock with head 5 by tapping on the head 37 of the insert removal tool 35. In other embodiments of the invention to be described hereinafter, it will be understood that the tool of FIG. 1A can be used to remove the taper locked insert from the head in a similar manner to that described in connection with FIG. 1.

Figure 3:
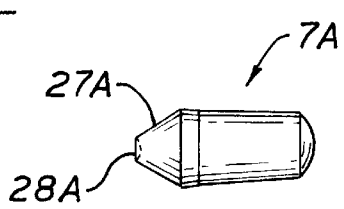
FIG. 3 is one variation of a cutting insert for the arrangement of FIG. 1.
Figure 4:
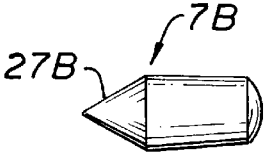
FIG. 4 shows an alternative configuration for a cutting insert in the arrangement of FIG. 1.
Figure 5:
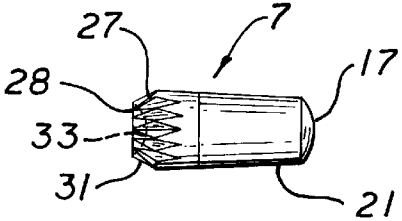
FIG. 5 shows the cutting insert depicted in FIG. 1, removed from the FIG. 1 arrangement.

FIGS. 3–5 show three different configurations for the tip portion of the cutting insert 7, and it will be understood that a variety of other possibly configurations and geometries are within the scope of the present invention, the variations shown in FIGS. 3–5 being exemplary only.

Figure 7:
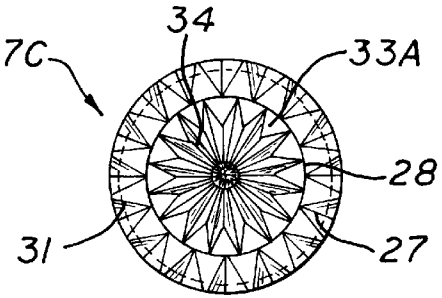
FIG. 7 is a view similar to that of FIG. 6 and showing additional interior flutes on the cutting insert face.
Figure 6:
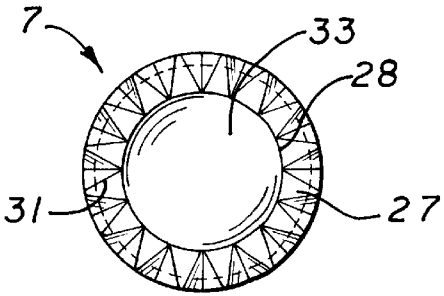
FIG. 6 is an end-on view of the cutting face of the frustum cutting insert of FIG. 5 showing exterior flutes.

The forward end of cutting insert 7A shown if FIG. 3 is a frusto conical tip 27A presenting a circular cutting edge to the material or substance being cut. In FIG. 4, the cutting insert 7B shows a conical tip 27B. The fluted frusto conical tip 27 shown in FIG. 5 is the same as that shown in FIG. 1, the fluted tip being formed with exterior flutes 31 as shown in FIG. 6 or with exterior flutes 31 and interior flutes 34 as shown on cutting insert 7C in FIG. 7. An obvious alternate variation is a fluted tip having only interior flutes (not shown). It should be noted that each frustum cutting insert 7, 7*a* has a concave depression 33 which, when meeting with the inwardly tapered tip portion 27, 27A, forms a circular cutting edge 28, 28A.

Figure 8:
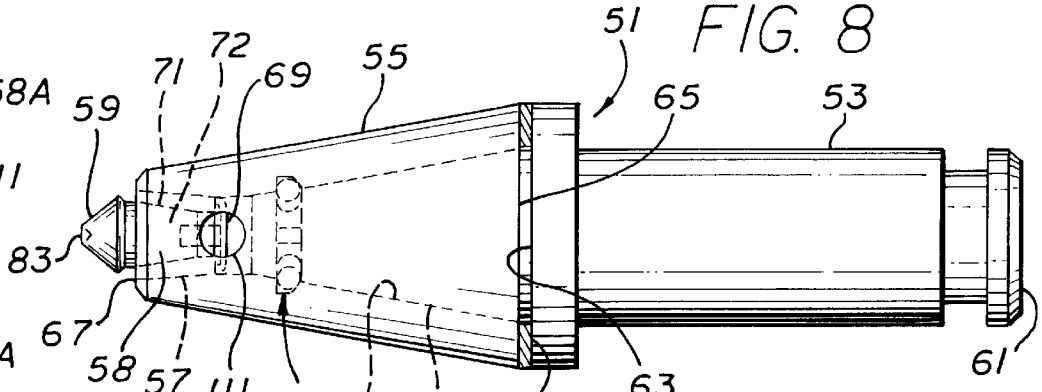
FIG. 8 shows an alternative embodiment of a frustum cutting bit arrangement having a stator and a rotatable head, as well as a rotatable cutting insert in the rotatable head.

FIG. 8 is an embodiment of the invention in which the head and cutting insert both are rotatable. As shown in FIG. 8, a frustum cutting bit arrangement 51 has a shank or stator portion 53 having an inner end 61 and an outer end 63, a head or rotor portion 55 having a rear end 65 and a front end 67, and a rotatable cutting bit insert arrangement 57 carrying a cutting bit 58. An access opening 111 is provided in head 55 for removal of insert 57 as hereinbefore described.

Figure 11:
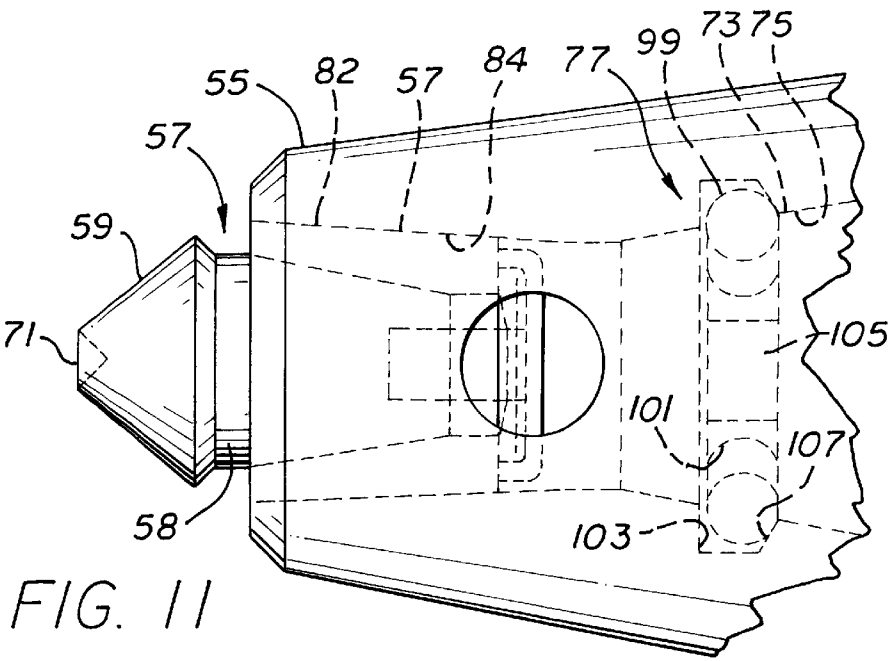
FIG. 11 is an enlarged view of the forward section of the rotating head and rotatable frustum cutting insert of FIG. 8.
Figure 12:
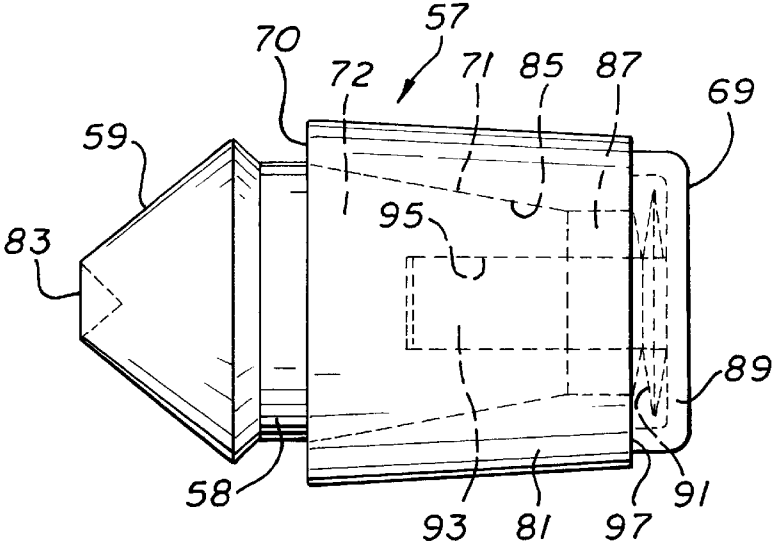
FIG. 12 is a view of the cutting insert shown in FIGS. 8 and 11 illustrating the construction permitting the frustum cutter bit to rotate within the cutting insert.

FIGS. 11 and 12 are enlarged portions of FIG. 8 which may assist in understanding the structure and function of the FIG. 8 embodiment.

The outer end of shank 53 has a forward end with an outer conical bearing surface 73 being in surface contact with an interior conical bearing surface 75 formed in the head 55. Preferably, the contacting bearing surfaces 73, 75 are treated with a diamond coating, available from QQC, Inc. of Dearborn, Mich., to reduce the sliding friction between the mating conical surfaces.

Figure 9:
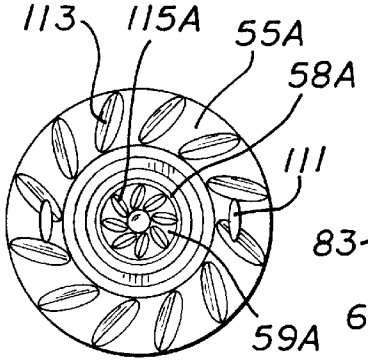
FIG. 9 is a left end view of the arrangement of FIG. 8 showing the addition of flutes formed on both the head and frustum cutting insert.
Figure 10:
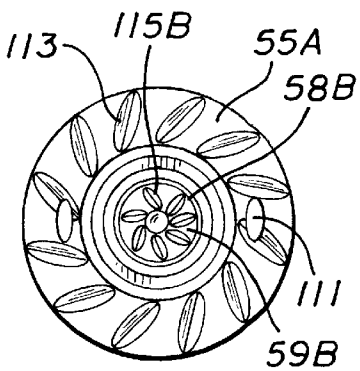
FIG. 10 is a view similar to that of FIG. 9 with the flutes on the insert and head being oppositely angled.

Since both the head 55 and frustum cutting insert 58 are rotatable relative to each other and relative to the shank portion 53, advantage can be taken of this dynamic relationship by providing a pattern of grooves or flutes on the outer surface of the head portion 55 and the outer portion of the insert tip 59 as shown in the right end views of FIGS. 9 and 10. In FIG. 9, for example, the flutes 113 on the surface of head portion 55A are angled relative to the axis of the cutting bit arrangement in the same angular direction as the smaller flutes 115A formed on the insert tip 59A of the rotatable frustum cutter bit 58A. As mentioned previously, these grooves or flutes 113 serve to direct particles, chipped from the surface being cut, away from the cutting operation to avoid clogging of the cutting bit arrangement or the entire rotary cutting tool.

In FIG. 10, the fluted head portion 55A is the same as that shown in FIG. 9, but the insert tip 59B on cutter bit 58B has its flutes 115B angled in the opposite direction than those on the tip 59A. In this manner, when the head and cutter bit rotate, they tend to direct debris in opposite directions for a more even distribution of the debris away from the vicinity of the cutting operation.

FIG. 11 is an enlarged view of the forward portion of head 55 shown in FIG. 8 to illustrate the axial locking mechanism 77 which locks the shank portion 53 to the head portion 55 axially but permits relative rotation therebetween. In the forward end of the inner conical surface 75 of head 55, an annular groove 103 is formed. Likewise, in the forward portion of the outer conical surface 73 of the shank portion 53, an annular groove 101 is formed. A circular locking ring 99, shown in phantom cross section in FIG. 11, has a predetermined relaxed diameter as shown in FIG. 11, i.e. with the center of the circular cross section of the locking ring 99 located approximately at the interface between the mating conical surfaces 73 and 75. In this configuration, the head 55 is locked onto the shank portion 53 due to the locking of the walls of annular grooves 101 and 103 by the circular locking ring 99.

Locking ring 99 has an opening 105 along its circular length for collapsing the circular locking ring 99 inwardly, i.e. radially inwardly and seating more deeply into the annular groove 101 formed in the shank portion 53.

In order to more easily collapse circular locking ring 99, the inner wall surface 107 of annular groove 103 may be tapered rearwardly. As a result, applying a force tending to separate the head 55 from the shank portion 53 will cam the circular locking ring 99 inwardly by the tapered edge 107, until the locking ring 99 is inserted far enough into groove 101 that the inner surface 75 of head 55 will pass over the collapsed locking ring 99. Upon replacement of the rotatable head 55, the inner conical surface 75 of the head 55 gradually cams the circular locking ring 99 inwardly until it snaps back into annular groove 103 as shown in FIG. 11.

It will be noted that the normal locked position for locking ring 99 within annular groove 103 is such that the ring 99 contacts the rear tapered surface 107. This is due to a preload being applied to the head 55 as the circular locking ring self-expands radially outwardly to cam surface 107 rearwardly and bring the bearing surfaces 73, 75 into mutual engagement.

FIG. 12 is an enlarged view of the forward portion of the arrangement shown in FIG. 8 depicting the elements comprising the rotatable cutting bit insert arrangement 57. A taper lock bearing sleeve 81 has an outer conical surface 82 taper locking with an inner conical surface 84 of the head portion 55 (see FIGS. 8 and 11). Accordingly, sleeve 81 is taper locked to head 55 and does not rotate relative to the head 55. However, the inner conical surface 85 of the taper lock bearing sleeve 81 is a bearing surface against which the outer bearing surface 71 of a cutter bit 58 bears in a preload condition by the effect of compression spring 91 tending to press bearing cap 89 outwardly. Compression spring 91 may be helical, split ring type, or, preferably one or a stack of belville springs. Bearing cap 89 has a stud 93 press fitted into a cylindrical bore 95 formed in the rear of rotatable frustum cutter bit 58. The mutually engagable bearing surfaces 71 and 85 are preferably treated with the aforementioned diamond coating available from QQC, Inc.

In assembling the rotatable cutting bit insert arrangement 57 of FIG. 12, the compression spring or spring stack 91 is placed over stud 93, and the bit 58 is inserted from the front of the sleeve 81 as the stud 93 is pushed into stud mounting bore 95 from the rear. A press fit with the stud 93 penetrating to the optimum position in bore 95 is achieved when the bearing surfaces 71, 85 are in mutual sliding engagement, and a minimal gap 97 is left at the interface between the bearing cap 89 and the rear surface of sleeve 81 defining preferably diamond coated, preload thrust bearing surfaces therebetween. Under these conditions, the rotatable frustum cutter bit 58 is seated in taper lock bearing sleeve 81 leaving an air gap 87 at the rear. As with other rotatable frusto conical cutters, the cutting action at the forward end 83 of the cutter bit 58 tends to rotate the bit, and in the embodiment of FIG. 8, may serve to rotate the bit and/or the head 55.

An annular seal ring 79 is placed between the rear end 65 of head 55 and the outer end 63 of shank portion 53 to keep out dust and other contaminants from the bearing surfaces 73, 75.

Figure 13:
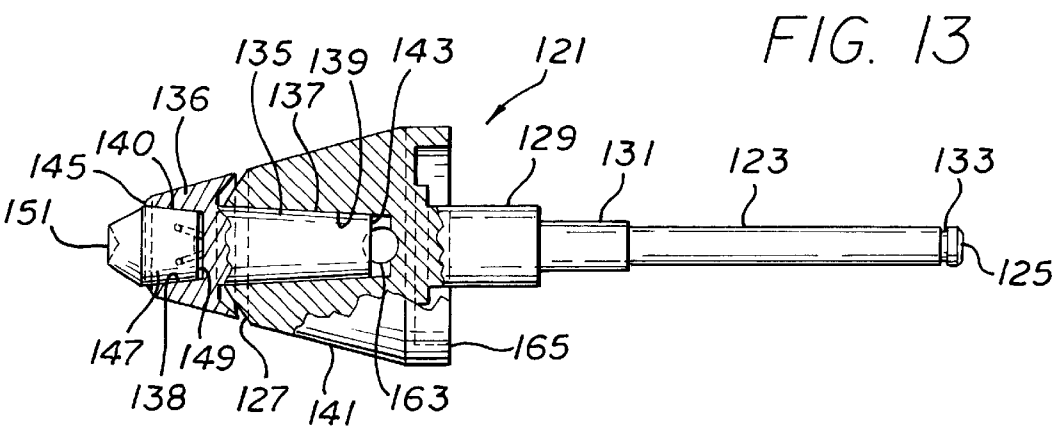
FIG. 13 depicts a further embodiment of a rotatable head portion for a cutting bit arrangement having a fixed cutting insert holding a fixed cutter bit.

FIG. 13 also shows a rotatable head arrangement 121, but with an alternative bearing arrangement from that shown in FIG. 8. In the embodiment of FIG. 13, the head 121 has a shaft 123 rotatable within a shank of the type shown in FIG. 20 to be discussed hereinafter. The shaft 123 has a rear end 125 with an annular locking groove 133 which accommodates a locking ring when the head 121 is assembled in a shank portion.

Head 121 also is provided with a forward radial bearing support surface 129 and an intermediate radial bearing support surface 131, again cooperating with the shank portion for mutual rotation therewith.

The head 121 has an outer conical surface 141 with a rear end 165 and a forward end 127, the forward end 127 having a greater taper angle than the conical surface 141. The forward end 127 has a taper lock bore 139 therein for accommodating, in a taper lock fashion, the outer taper lock conical surface 137 of a cutting insert 136.

The forward end 145 of the cutting insert 146 has a taper lock conical surface 138 formed therein to receive a cutter bit 147 having a tapered outer surface 140. Accordingly, the cutter bit 147, insert 136, and head 121 are serially taper locked together.

Figure 14:
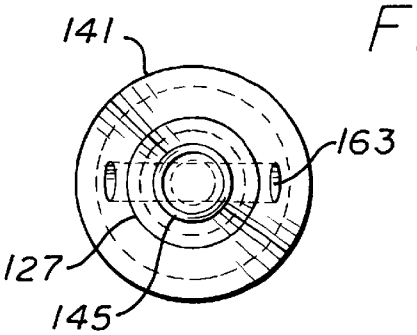
FIG. 14 is a left end view of the head portion shown in FIG. 13.

FIG. 14 is a left end view of the head 121 of FIG. 13, an access opening 163 being provided for removal of insert 136 as hereinbefore described.

Figure 15:
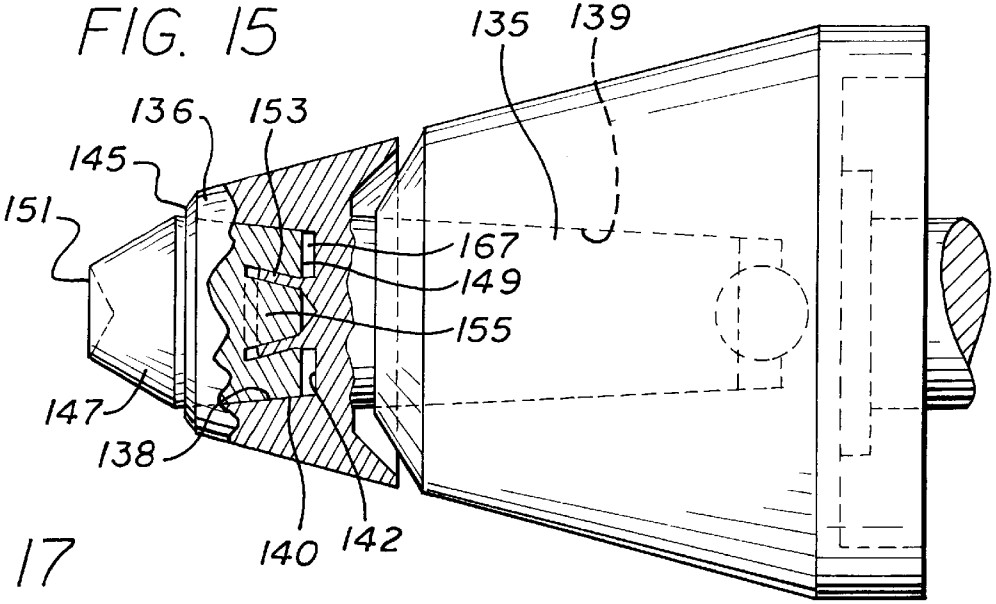
FIG. 15 is an enlarged view of the forward section of the head portion shown in FIG. 13.
Figure 16:
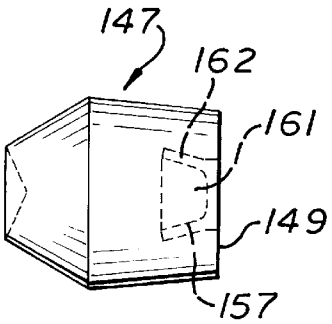
FIG. 16 is a side view of a cutter bit insertable into the cutting insert shown in FIG. 13.
Figure 17:
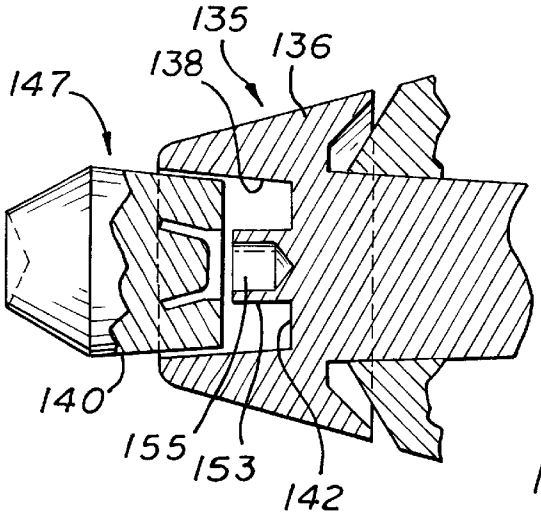
FIG. 17 is a partial side view showing the cutting insert and cutter bit prior to installing the cutter bit in the cutting insert of the head portion according to the embodiment of FIG. 13.

FIGS. 15–17 show, in enlarged representations, the features of attachment of the cutter bit 147 to the insert 136 and the insert 136 to the head 121. FIG. 17 shows a projecting tubular structure 153 extending from the bottom 142 of the opening 138. The tubular projection 153 has thin cylindrical walls, defining a cylindrical recess 155. On the mounting end 149 of cutter bit 147, as best seen in FIG. 16, a recessed truncated conical boss 161 is shown projecting rearwardly and having conical outer surface 157. As the cutter bit 147 is inserted into insert 136, the conical surface 157 of boss 161 begins to flare out the free end of the cylindrical projecting tube 153. As seen in FIG. 15, when the cutter bit 147 is fully taper locked within opening 138, the tubular projection 153 is flared outwardly to fill the annular conical void 162 in the mounting end of cutter bit 147. This flaring of the projecting tube 153 serves to permanently attach the cutter bit 147 to the insert 136, and yet the insert 136 has a long taper lock contact with the inner surface 139 of head 121. As a result, the more costly cutter bit 147 may be made small and permanently attached to an intermediate insert 136 made of less expensive material. Insert 136, nevertheless, is fully insertable into head 121 and releasable therefrom for replacement. This measure reduces the cost of the frustum cutting insert assembly comprising the insert 136 and cutter bit 147 while advantageously making a long and solid taper lock with the head 121.

Figure 18:
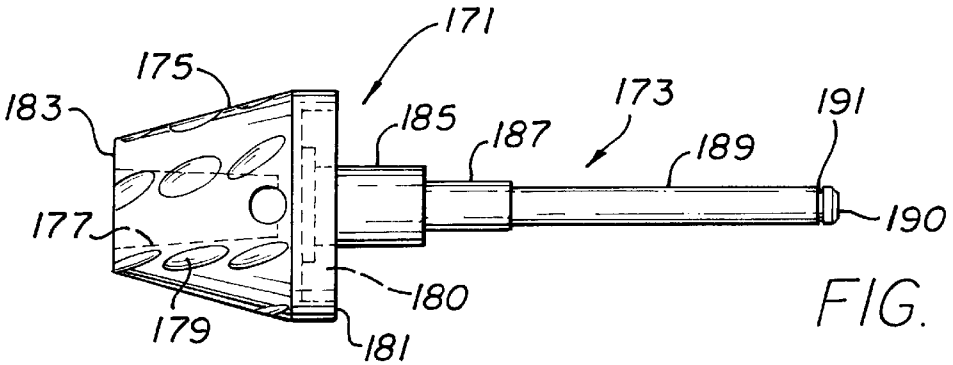
FIG. 18 shows a further embodiment of a rotatable head portion having flutes on its outer forward conical surface.
Figure 19:
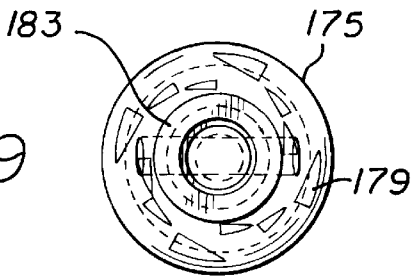
FIG. 19 is a left end view of the head portion shown in FIG. 18.
Figure 20:
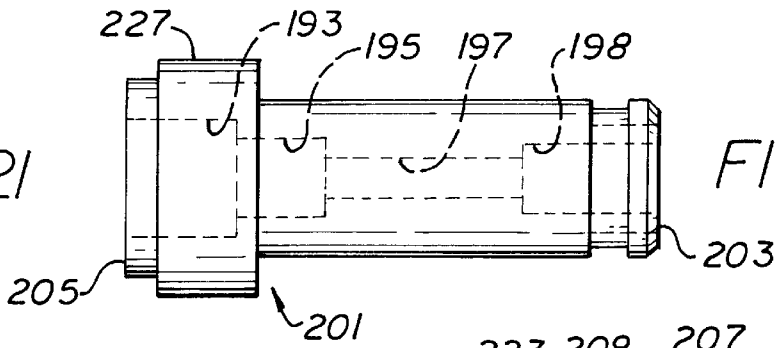
FIG. 20 is a side view of the shank or stator portion of the cutting bit arrangement which can accommodate the rotatable heads shown in FIGS. 13 or 18.

FIG. 18 is yet another head portion 171 that can be rotatably coupled to a shank portion 201 shown in FIG. 20. Head portion 171 has a rear end 190 with an annular locking ring groove 191. A shaft 189 extends from an intermediate radial bearing support surface 187 and a forward radial bearing support surface 185, the latter connected to the rear of the conical head portion 175. The conical head portion 175 has a rear end 181 and a front end 183, the latter having a tapered opening 177 for receiving a frustum cutting insert in taper lock fashion. FIG. 19 is a left end view of the head portion 171 shown in FIG. 18.

The outer surface of the conical head portion 175 has a series of guide grooves 179 having sharp edges to guide debris away from the cutting process as the head 171 rotates within shank 201.

The shank portion 201 shown in FIG. 20 accommodates any one of a number of different types of rotatable heads, the heads 121 and 171 of FIGS. 13 and 18 being examples only. Another example is shown in FIG. 22.

Figure 21:
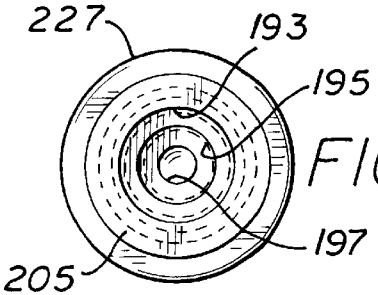
FIG. 21 is a left end view of the shank portion of FIG. 20.

FIG. 21 is a right end view of the shank portion 201 of FIG. 20.

Figure 22:
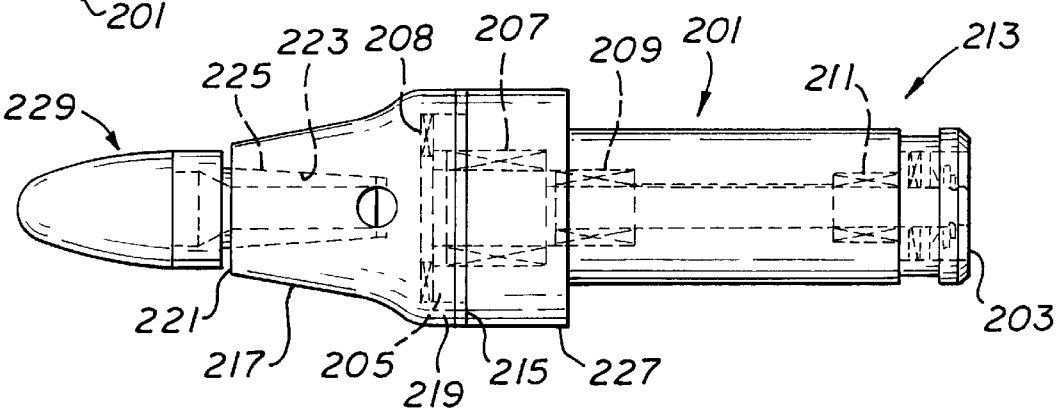
FIG. 22 is illustrative of a further embodiment of the invention, similar in construction to those shown in FIGS. 13–20 and illustrating the bearing components permitting the head portion to rotate relative to the shank portion, and with a variation of the cutting bit inserted in the head portion.
Figure 28:
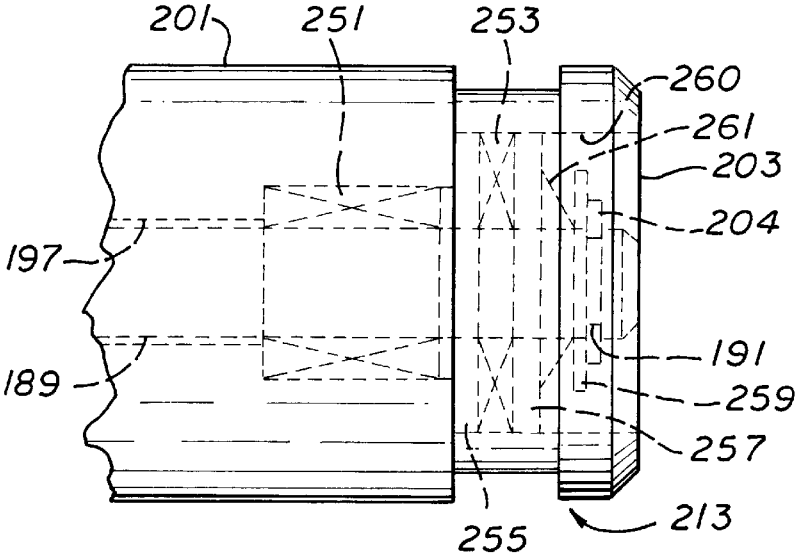
FIG. 28 is an enlarged view of the shank inner end and head rear end with reference to the arrangement shown in FIG. 22.

The fully assembled cutting bit arrangement shown in FIG. 22 will be used to explain the rotational relationship between the head portion and shank portion. FIG. 28 will also be helpful in the understanding of the configuration and function of the inner end 213 of the shank portion 201.

Returning to the combination of FIGS. 18 and 20, and viewing the assembled arrangement of FIG. 22, it will be observed that when the head 171 is inserted into shank portion 201, the shaft 189 is journalled in the elongated cylindrical passageway 197, and radial needle bearings are provided in three locations along the axis of the cutting bit arrangement so assembled: a bearing 211 at the rear of shank 201 between the shaft 189 and the rearward bearing support surface 198; the intermediate radial needle bearing 209 between the intermediate bearing support surfaces 187 and 195 on the head 171 and shank 201, respectively; and radial needle bearing 207 between the bearing surfaces 185 on head 171 and 193 on shank 201, respectively. An annular projecting flange 205 fits within annular void 180 in order to shield the bearing surfaces from dust and small particles resulting from the drilling/cutting action.

The head 217 of the FIG. 22 embodiment is rotatably mounted to the shank 201 employing thrust bearing 208 acting between the rotatable head 217 and the flange 205 of the shank 201. An annular sealing ring 215 is provided between the rear end 219 of the head 217 and the forward end of the collar 227 of shank 201. The sealing ring 215 keeps dust and small particles from reaching the bearing surfaces.

The front end 221 of head 217 in FIG. 22 has an opening with tapered conical walls 223 mating with the external conical wall 225 of a cutter insert 229, the two surfaces 223 and 225 effecting a taper lock therebetween.

Figure 23:
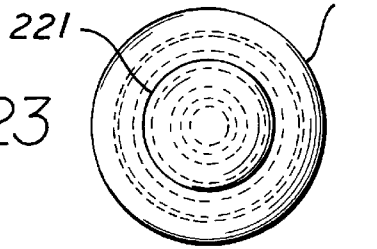
FIG. 23 is a left end view of the arrangement shown in FIG. 22.

FIG. 23 is a right end view of the cutting bit arrangement shown in FIG. 22.

Figure 25:
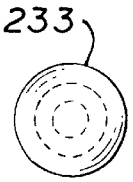
FIG. 25 is a left end view of the cutter bit of FIG. 24.
Figure 24:
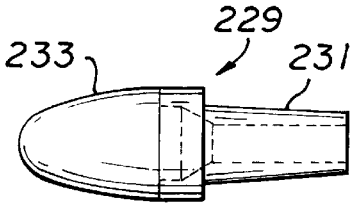
FIG. 24 is a side view of the cutter bit arrangement removed from the arrangement shown in FIG. 22, the cutter bit including an insert bit and a holder for the insert bit.
Figure 27:
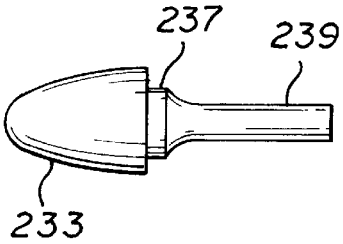
FIG. 27 depicts the insert bit part of the cutter bit shown in FIG. 24.
Figure 26:
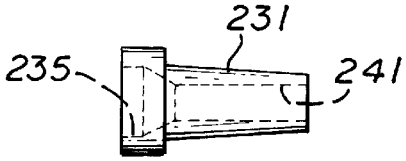
FIG. 26 is a side view of the holder for the insert bit of the cutter bit arrangement shown in FIG. 24.

Referring to FIGS. 24–26, the cutter bit 229 is comprised of two pieces, again to conserve the costly hardened material used for the cutting portion 233 of the cutter bit 229. In this assembly, the cutting portion 233 has a cylindrical shoulder 237 and a shaft 239. The shaft 239 fits in a cylindrical bore 241 in a cutter insert holder 231. The cutting portion 233 is inserted in holder 231, and the shoulder 237 is press fitted into the cylindrical press fit opening 235. The result is a taper lock holder made of less expensive material press fitted to a more costly cutting bit 233.

FIG. 28 shows the inner end portion of the shank 201 of FIG. 20 with the shaft 189 of the FIG. 18 embodiment inserted therein. The shaft 189 is inserted completely into the shank portion 201 which has a wide cylindrical opening 260 at its extreme inner end. After the shaft 189 is fully inserted in passageway 197, a first washer 255 is inserted over shaft 189, then a radial needle bearing 253 is placed against washer 255, and a second washer 257 is placed against bearing 253. A spring 261, preferably a belville spring, is then inserted over shaft 189, followed by another washer 259 serving as a backing for a lock ring 204 fitting into the annular groove 191 in shaft 189.

The compression spring 261 tends to pull the shaft 189 rearwardly of the shank portion 201 which, in turn, applies a preload to the thrust bearing surfaces of the various embodiments described.

Figure 30:
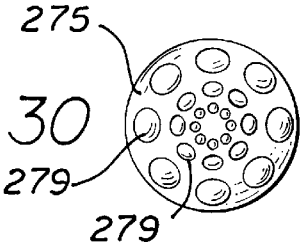
FIG. 30 is a left end view of the cutting insert shown in FIG. 29.
Figure 29:
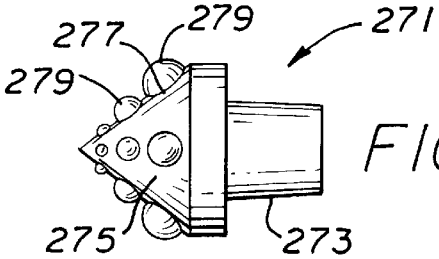
FIG. 29 is an alternative cutting insert having a number of varying sizes of pimples on its outer conical surface.

FIG. 29 shows another configuration for a cutter bit insert 271 having a plurality of various sizes of dimples 277 within which pimples, i.e. pellets, or lugs, 277 having spherical exposures, are fitted, the pimples 277 being distributed along a conical surface 275. A taper lock shank 273 permits the cutter bit insert 271 to be taper locked into any one of the described taper lock receivers in the head portions of the cutting bit arrangements. FIG. 30 is a left end view of the cutter bit insert shown in FIG. 29.

Figure 32:
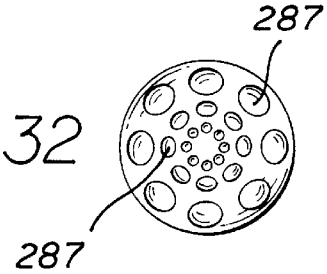
FIG. 32 is a left end view of the cutting insert of FIG. 31.
Figure 31:
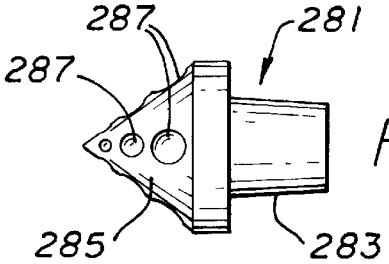
FIG. 31 is an alternative cutting insert having a number of varying sizes of dimples on its outer conical surface.

FIG. 31 is a view similar to that of FIG. 29, but without spherical pellets (pimples). Thus, cutter bit insert 281 has a plurality of sharp edge cutting dimples, or notches, 287 on the conical surface 285 and a taper lock shaft 283. FIG. 32 is a left end view of the cutter bit insert of FIG. 31.

While only certain embodiments of the invention have been set forth above, alternative embodiments and various modifications will be apparent from the above description and the accompanying drawing to those skilled in the art. These and other alternatives are considered equivalents and within the spirit and scope of the present invention.

I claim:

1. A frustum cutting bit arrangement, comprising:

a shank portion for mounting in, and to be retained by, a rotary cutting tool body, said shank portion having an axis, an inner axial end, and an outer axial end;

a head portion having an axis coincident with said shank portion axis, a front axial end, and a rear axial end, said rear end coupled to said shank portion outer end, and said front end having a conical cavity therein diminishing in diameter from said front end toward said rear end; and a frustum cutting insert having an axis coincident with said head portion axis, a forward axial end, a back axial end, and an outer conical surface diminishing in diameter from said forward end toward said back end, said conical cavity and said outer conical surface having substantially the same taper, said frustum cutting insert fitting into said cavity in a taper lock.

2. The frustum cutting bit arrangement as claimed in claim 1, wherein a bore is provided in said head portion exposing said back end of said insert, whereby a wedged tool inserted into said bore is effective to force said insert axially forward of said cavity and release said taper lock for removal of said insert from said head portion cavity.

3. The frustum cutting bit arrangement as claimed in claim 1, wherein said forward end of said frustum cutting insert has a conical shaped tip formed of tungsten carbide of uniform density.

4. The frustum cutting bit arrangement as claimed in claim 1, wherein said forward end of said frustum cutting insert has a truncated conical tip, the forward end of which has a concave inverse conical shaped surface, thereby forming a circular cutting edge at said forward end of said truncated conical tip.

5. The frustum cutting bit arrangement as claimed in claim 4, wherein said truncated conical tip has sharp edged serrations on its outer surface.

6. The frustum cutting bit arrangement as claimed in claim 4, wherein said concave forward end of said conical tip has sharp edged serrations on said inverse conical shaped surface.

7. The frustum cutting bit arrangement as claimed in claim 4, wherein:

said head portion has an outer conical surface diminishing in diameter forwardly; and at least one of said head portion outer surface and said frustum cutting insert forward end has a plurality of guide grooves angularly disposed relative to said head axis for diverting particles away from said frustum cutting bit arrangement upon rotation of said surface carrying said guide grooves.

8. The frustum cutting bit arrangement as claimed in claim 7, wherein:

a plurality of said guide grooves are provided in both said head portion outer surface and said frustum cutting insert forward end; and said guide grooves on said head portion outer surface are angled oppositely relative to the angle of said guide grooves on said frustum cutting insert forward end.

9. The frustum cutting bit arrangement as claimed in claim 1, wherein:

said outer end of said shank portion is conical, diminishing in diameter forwardly, and having an outer conical surface defining a first bearing surface;

said rear end of said head portion has an inverse conical cavity therein, diminishing in diameter forwardly, and having an inner conical surface defining a second bearing surface; and a locking mechanism axially fixing said head portion to said shank portion without restricting relative rotation between said head and shank portions, and with said first and second bearing surfaces in surface contact, whereby said head portion is freely rotatable relative to said shank portion.

10. The frustum cutting bit arrangement as claimed in claim 9, wherein:

said outer conical end of said shank portion has a first annular groove therein;

said inner conical surface of said head portion has a second annular groove therein; and said locking mechanism comprises a circular locking ring fitting partially within both said annular grooves when said first and second bearing surfaces are in surface contact.

11. The frustum cutting bit arrangement as claimed in claim 10, wherein:

said locking ring is compressible radially to be fully positioned within said shank portion annular groove upon sliding said head portion onto, and axially locking with, said shank portion.

12. The frustum cutting bit arrangement as claimed in claim 11, wherein said annular groove in said shank portion conical surface has forward and rearward radial walls, and said rearward radial wall is beveled adjacent said shank portion conical surface.

13. The frustum cutting bit arrangement as claimed in claim 9, wherein said frustum cutting insert has an internal axially extending opening with an interior conical surface defining a first insert bearing surface, said frustum cutting insert further comprising:

a rotatable cutter having a cutting end, a mounting end, and an intermediate external conical surface defining a second insert bearing surface mating with said first insert bearing surface; and a retainer coupling said mounting end of said cutter to said back end of said frustum cutting insert.

14. The frustum cutting bit arrangement as claimed in claim 13, wherein said frustum cutting insert comprises bearing means applying a bearing preload between said mounting end of said cutter and said back end of said frustum cutting insert.

15. The frustum cutting bit arrangement as claimed in claim 1, wherein said frustum cutting insert has an internal axially extending opening with an interior conical surface defining a first insert bearing surface, said frustum cutting insert further comprising:

a rotatable cutter having a cutting end, a mounting end, and an intermediate external conical surface defining a second insert bearing surface mating with said first insert bearing surface; and a retainer coupling said mounting end of said cutter to said back end of said frustum cutting insert.

16. The frustum cutting bit arrangement as claimed in claim 15, wherein said frustum cutting insert comprises bearing means applying a bearing preload between said mounting end of said cutter and said back end of said frustum cutting insert.

17. The frustum cutting bit arrangement as claimed in claim 1, wherein said frustum cutting insert has an internal axially extending opening with an interior conical surface defining a female taper lock surface, said frustum cutting insert further comprising:

a cutter having a cutting end, a mounting end, and an intermediate external conical surface defining a male taper lock surface mating with said female taper lock surface.

18. The frustum cutting bit arrangement as claimed in claim 17, wherein:

said opening in said cutting insert has a bottom wall with a forwardly directed hollow cylindrical tube formed at the center of said bottom wall, said tube having a predetermined length; and said mounting end of said cutter has a central annular groove therein of a depth sufficient to accommodate said tube predetermined length, said central angular groove diverging outwardly forwardly of said insert cutter mounting end, whereby upon seating of said cutter in said insert opening, said tube enters said diverging annular groove and is flared outwardly to assist in locking said cutter to said insert.

19. The frustum cutting bit arrangement as claimed in claim 17, wherein:

said front end of said head portion is beveled, defining a beveled nose; and said insert comprises a rearwardly directed skirt portion radially covering said beveled nose, shielding said front end of said head portion from laterally directed debris.

20. The frustum cutting bit arrangement as claimed in claim 1, wherein:

said shank portion has a longitudinal axis opening therein;

said head portion comprises an axial shaft directed rearwardly of said rear end; and said frustum cutting bit arrangement further comprises a bearing set acting between said head portion and said shank portion to facilitate relative rotation therebetween.

21. The frustum cutting bit arrangement as claimed in claim 20, comprising a preload spring arrangement tending to pull said rear end of said head portion toward said outer end of said shank portion.

22. The frustum cutting bit arrangement as claimed in claim 1, wherein:

said frustum cutting insert has an internal axially extending cylindrical opening with a forwardly disposed receiver portion; and said frustum cutting bit arrangement comprises a cutter bit having a cylindrical shaft fitting in said cylindrical opening, and a shoulder portion press fitted onto said receiver portion, whereby hardened material making up said cutter bit is conserved.

23. The frustum cutting bit arrangement as claimed in claim 1, wherein said frustum cutting insert comprises a nose portion having a conical outer surface in which a plurality of sharp edged dimples are formed.

24. The frustum cutting bit arrangement as claimed in claim 23, wherein said frustum cutting insert comprises a plurality of hard material pellets secured in corresponding ones of said dimples and presenting a substantially spherical segment to substance being removed by said frustum cutting bit arrangement.

25. The frustum cutting bit arrangement as claimed in claim 23, wherein said dimples are of a variety of different sizes.

26. The frustum cutting bit arrangement as claimed in claim 24, wherein said pellets are of a variety of different sizes.

* * * * *